United States Patent [19]

Landrum

[11] Patent Number: 4,962,782

[45] Date of Patent: Oct. 16, 1990

[54] APPARATUS FOR OPENING AND CLOSING TENT ZIPPERS

[76] Inventor: Joseph C. Landrum, 10127 Pawnee Rd., West Salem, Ohio 44287

[21] Appl. No.: 418,194

[22] Filed: Oct. 6, 1989

[51] Int. Cl.[5] ..... E04H 15/64

[52] U.S. Cl. ..... 135/119; 223/111; 294/3.6; 135/117

[58] Field of Search ..... 135/96, 119, 117; 223/111; 294/3.6

[56] References Cited

U.S. PATENT DOCUMENTS 3,568,901 3/1971 McNitt ..... 223/111
4,117,961 10/1978 Pickens ..... 223/111

FOREIGN PATENT DOCUMENTS 1362124 7/1974 United Kingdom ..... 223/111

*Primary Examiner*—David A. Scherbel
*Assistant Examiner*—Lan Mai
*Attorney, Agent, or Firm*—Michael Sand Co.

[57] ABSTRACT

An apparatus for opening and closing vertically extending, generally straight-line tent zippers without reaching and bending. A first embodiment of the invention includes a first pulley removably mounted on a stake adjacent to and aligned with a lower end of the zipper. A pair of plates each is formed with a plurality of spaced peripheral openings and has a pulley rotatably mounted thereon adjacent to and aligned with another opening formed in the plate. The plates are placed together in a back-to-back relationship so that the plate openings are aligned with each other and with a plurality of corresponding openings formed in the intervening tent wall, for fastening the plates and attached pulleys on the tent adjacent to and aligned with the upper end of the zipper. A cord is attached to the sliding member of the zipper and extends between the pulleys by passing through the other opening of the plates and tent wall and through an opening between the ground and the tent wall adjacent to the lower end of the zipper, so that upon manual pulling of the cord the sliding member slides between the upper and lower ends of the zipper for opening and closing an access opening formed in the tent wall. A second embodiment of the invention is intended for use with tests having an opening formed above the zipper, and replaces the pair of plates and attached pulleys of the first embodiment with a single pulley suspended from the tent frame.

19 Claims, 4 Drawing Sheets

APPARATUS FOR OPENING AND CLOSING TENT ZIPPERS

BACKGROUND OF THE INVENTION

1. Technical Field

The invention relates to apparatus for opening and closing zippers, and in particular to an apparatus for opening and closing tent zippers. More particularly, the invention relates to such an apparatus for opening and closing a generally linearly vertically extending tent zipper without reaching and bending.

2. Background Information

All types of tents have been and continue to be popular items for numerous outdoor activities such as family camping vacations and backyard get togethers. Many larger tents such as cabin-style tents have floor-to-ceiling center heights usually of at least six or seven feet. The access opening formed in these larger tents typically has a comparable height and is opened and closed by a vertically extending straight-line zipper. Thus, it can be seen that opening and closing the zipper on such tents is inconvenient for adults since bending and reaching is required, and can be extremely difficult or impossible for small children and physically disabled individuals.

Thus, the need exists for an apparatus for opening and closing a generally linearly vertically extending tent zipper without bending and reaching.

SUMMARY OF THE INvENTION

Objectives of the invention include providing an apparatus for opening and closing tent zippers which completely opens and closes a generally linearly vertically extending tent zipper without requiring reaching or bending by an individual operating the apparatus.

Another objective of the invention is to provide such an apparatus for opening and closing tent zippers which can be quickly and easily securely installed and operated on most tents having generally linearly vertically extending zippers, by a single person without damaging the tent fabric or frame.

A further objective of the invention is to provide such an apparatus for opening and closing tent zippers which is simple to install and operate, inexpensive, lightweight, durable, and substantially maintenance-free.

These objectives and advantages are obtained by the apparatus for moving a sliding member of a generally linearly vertically extending zipper attached to a wall of a tent, between an upper end and a lower end of the zipper for opening and closing an access opening formed in the tent wall, the general nature of which may be stated as including, a first pulley adapted to be positioned adjacent to and aligned with the lower end of the zipper, a second pulley adapted to be positioned adjacent to and aligned with the upper end of the zipper, and cord means attached to the sliding member of the zipper and extending between the pulleys, for moving the sliding member between the upper and lower ends of the zipper for opening and closing the access opening of the tent, upon movement of the cord means.

BRIEF DESCRIPTION OF THE DRAWINGS

Preferred embodiments of the invention, illustrative of the best modes in which applicant has contemplated applying the principles, are set forth in the following description and are shown in the drawings and are particularly and distinctly pointed out and set forth in the appended claims.

Similar numerals refer to similar parts throughout the drawings.

DESCRIPTION OF THE PREFERRED EMBODIMENTS

Figure 1:
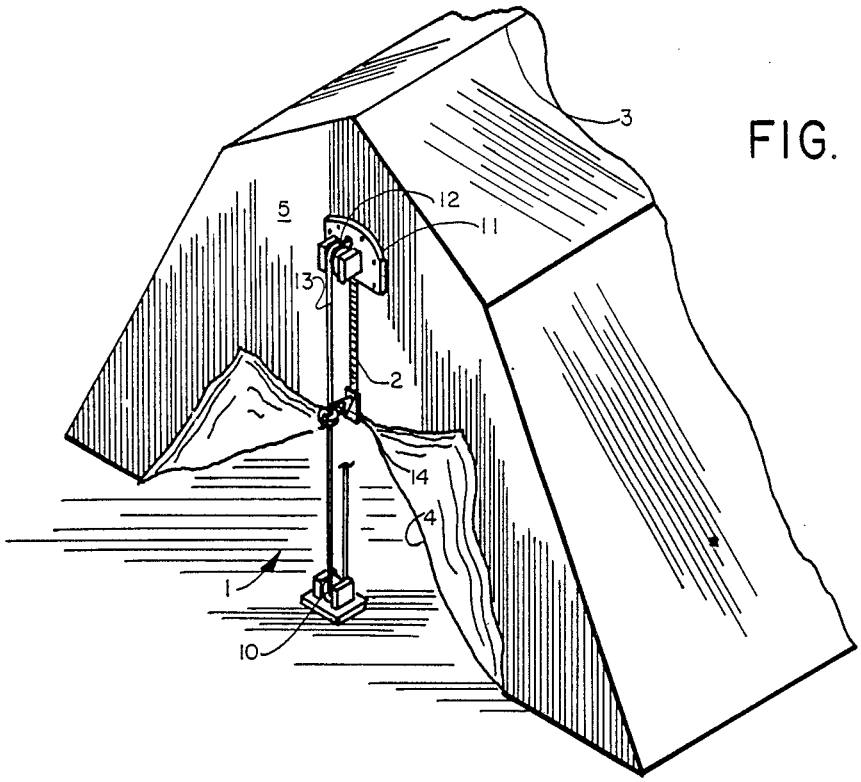
FIG. 1 is a fragmentary perspective view of a first embodiment of the apparatus of the present invention, mounted adjacent to a tent zipper for opening and closing the zipper.

A first embodiment of the apparatus of the present invention for opening and closing tent zippers, is indicated generally at 1 and is shown in FIG. 1 in its intended use mounted adjacent to a zipper 2 of a tent 3. Apparatus 1 can be used with virtually any type or style of tent 3 having a generally straight-line or linearly vertically extending zipper 2, for opening and closing an access opening 4 formed in a front wall 5 of the tent. However, apparatus 1 is primarily intended for use with larger, walk-in type cabin tents, add-on tent rooms, or the like, which are similar to tent 3 illustrated in FIG. 1. These larger tents 3 typically have a zipper 2 extending substantially the floor-to-ceiling height of the tent, which is usually at least six or seven feet, thus necessitating inconvenient reaching and bending to open and close the zipper. Such reaching and bending is particularly difficult, and often impossible, for small children and physically disabled individuals.

Figure 5:
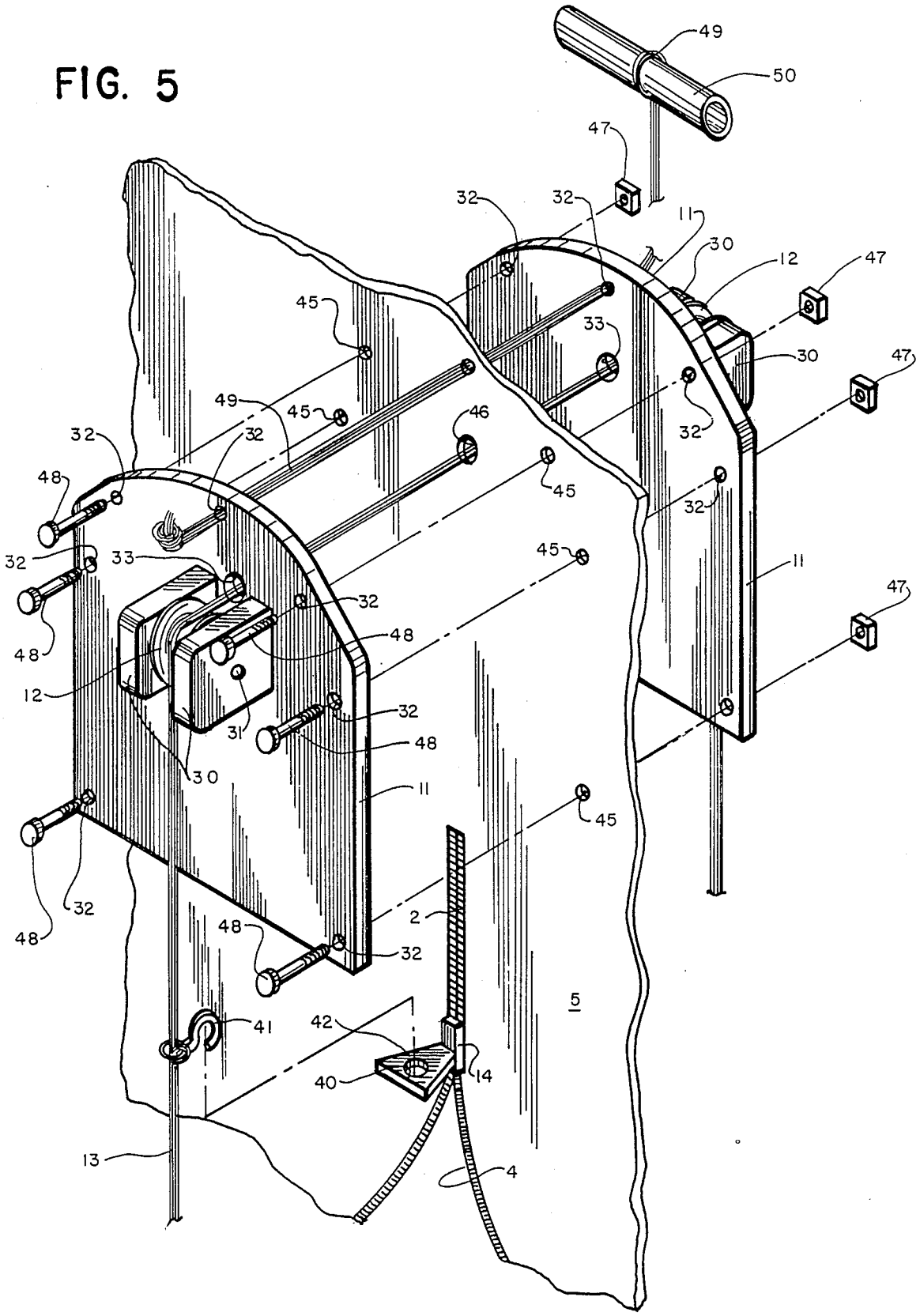
FIG. 5 is an enlarged fragmentary exploded perspective view of the plates and attached pulleys of the apparatus, showing the manner of their attachment to the tent adjacent to the upper end of the zipper, and the manner in which the endless cord extends between the pulleys and is attached to the slide member of the zipper.
Figure 6:
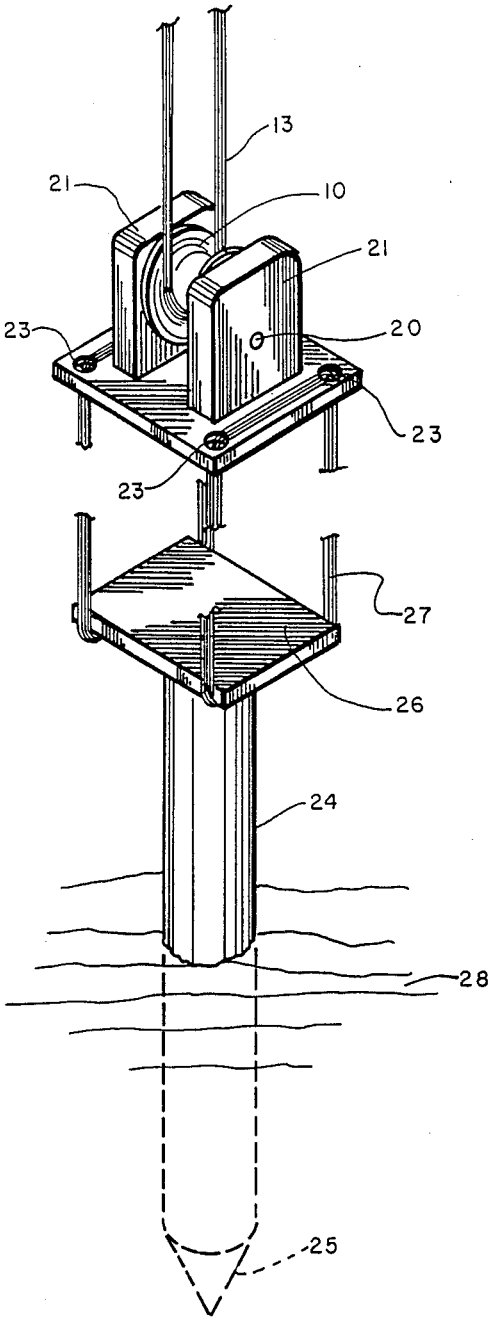
FIG. 6 is an enlarged fragmentary exploded perspective view of the lower pulley of the apparatus, showing the manner in which the pulley is removably mounted on a stake for supporting the pulley in the ground.
Figure 7:
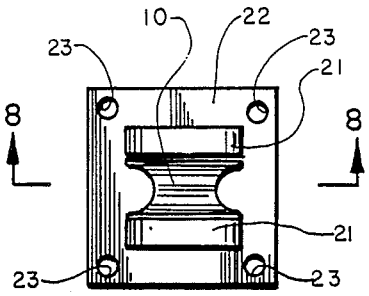
FIG. 7 is a top plan view of the lower pulley of the apparatus.
Figure 8:
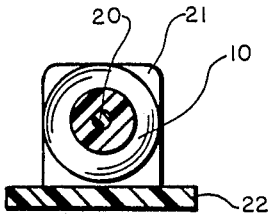
FIG. 8 is a sectional view taken on line 8—8, FIG. 7.

Apparatus 1 includes a pulley 10 mounted adjacent to the lower end of zipper 2, a pair of similar plate members 11 each having a pulley 12 rotatably mounted thereon which are mounted adjacent to the upper end of the zipper, and an endless cord 13 which is attached to a sliding member 14 of zipper 2 and extends between the pulleys (FIGS. 1, 5 and 6). Pulley 10 is mounted on a shaft 20 which extends between and is rotatably mounted on a pair of spaced parallel brackets 21, which are attached to and extend upwardly from a base 22 (FIGS. 7 and 8). Base 22 is formed with four spaced, equally distant openings 23 therein for removably mounting the base and attached pulley 10 on a support stake 24. More particularly, support stake 24 is formed with a pointed lower end 25 for easily driving the stake into ground 28, and has a platform 26 attached to its upper end for mounting base 22 thereon subsequent to pounding the stake into the ground. Base 22 is removably mounted on platform 26 by passage of a rope 27 through openings 23 in any suitable configuration, and securing the rope to the platform such as by tying. It is understood that other means of attaching base 22 to platform 26 could be employed without affecting the concept of the invention, such as passing bolts through openings 23 and aligned openings formed in platform 26, and securing the bolts thereon with nuts.

Figure 2:
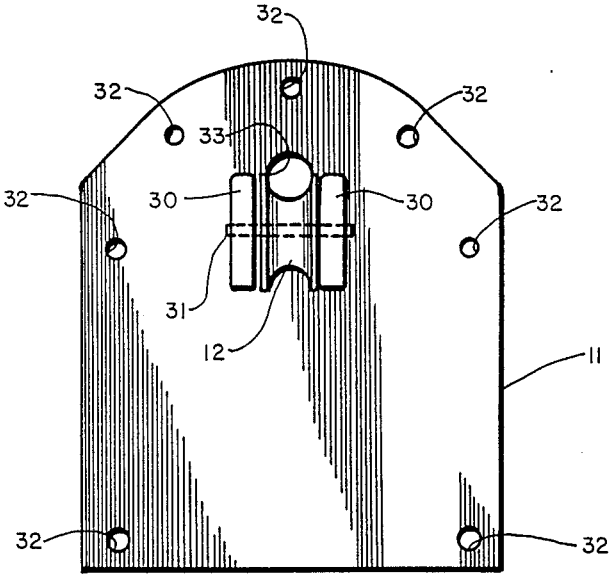
FIG. 2 is a front elevational view of one of the plates and attached pulley of the apparatus.
Figure 3:
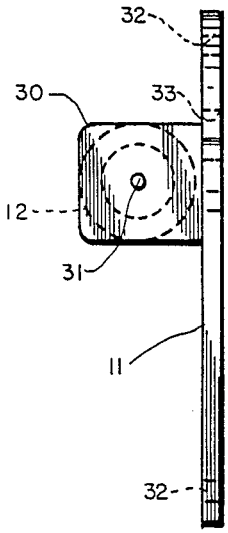
FIG. 3 is a right-hand side elevational view of the plate and attached pulley of FIG. 2.
Figure 4:
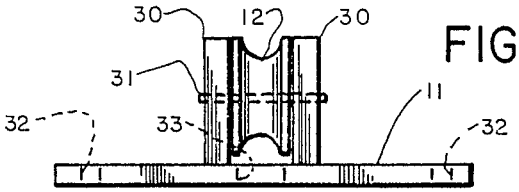
FIG. 4 is a bottom elevational view of the plate and attached pulley of FIG. 2.

Since plate members 11 are similar in construction and operation, only one will be described herein. Plate member 11 includes a pair of spaced, parallel outwardly extending brackets 30 attached thereto (FIGS. 2–4). Pulley 12 is mounted on a shaft 31 which extends between and is rotatably mounted on brackets 30. A plurality of spaced openings 32 are formed along the peripheral edge of plate 11, and another larger opening 33 is formed in plate 11 above and generally aligned with the outer circumference of pulley 12.

A catch 41 is immovably attached to cord 13 such as by tying, and also is removably engaged in an opening 40 formed in a tab 42 attached to sliding member 14 of zipper 2 (FIG. 5), for moving the sliding member between the upper and lower ends of the zipper to open and close access opening 4 formed in front wall 5 of tent 3.

Apparatus 1 is mounted adjacent to zipper 2 of tent 3 and operated in the following manner. Support stake 24 is pounded into ground 28 so that when base 22 subsequently is attached to platform 26 by rope 27 as described above, pulley 10 will be aligned with the lower end of zipper 2 (FIG. 1). A plurality of openings 45 and another single opening 46 are formed in front wall 5 of tent 3 adjacent to the upper end of zipper 2, by using openings 32 and 33, respectively, of one of the plate members 11 as a template (FIG. 5). Plate members 11 then are placed in a back-to-back relationship against the inside and outside surfaces of front wall 5 so that openings 32 and 33 thereof are aligned with each other and with the corresponding openings 45 and 46 of intervening tent wall 5. A plurality of bolts 48 then are passed through aligned openings 32 and 45 of plates 11 and tent wall 5, respectively, and are secured therein by a plurality of nuts 47 which draw the plates tightly against each other for securely mounting the plates on the tent wall, so that pulleys 12 are aligned with the upper end of tent zipper 2.

If desired, one set of nuts and bolts 47 and 48, preferably the set of the uppermost aligned openings 32 and 45 of plates 11 and tent wall 5, respectively, can be substituted with a rope 49 (FIG. 5) which is knotted at one of its ends, with the other end being passed inwardly through the aligned openings and being secured by tying to an inside frame member 50 of tent 3. Rope 49 will assist in supporting plate members 11 on tent wall 5 by suspending the plate members thereon, and aid in preventing damage such as tears to the fabric of the tent wall at openings 45 when downward pulling forces are exerted on pulleys 12 of the plate members and in turn bolts 48, by cord 13 during the operation of apparatus 1.

One end of cord 13 then is secured to catch 41, and the opposite end thereof is passed around pulley 12 of the outside plate member 11 (FIG. 5), through aligned openings 33 and 46 of plate members 11 and tent wall 5, respectively, around pulley 12 of the inside plate member 11, down and through an opening (not shown) formed between the ground 28 and the lower edge of tent wall 5 adjacent to the lower end of zipper 2, and around pulley 10, afterwhich the opposite end of the cord is tied to catch 41 to form an endless cord which extends between pulleys 12 and 10. Catch 41 then is removably attached to slide member tab 42 of zipper 2 in the manner previously described.

When it is desired to open or close zipper 2, cord 13 is pulled upwardly or downwardly, depending on whether the operator of apparatus 1 is standing on the inside or outside of tent 3. It thus can be seen that mere pulling of cord 13 moves sliding member 14 between the upper and lower ends of zipper 2 for opening and closing the zipper, respectively, thereby eliminating the heretofore necessary reaching and bending to accomplish movement of the slide member.

The components of apparatus 1, except for cord 13, all preferably are formed of any suitable strong, lightweight plastic capable of enduring the weather elements.

Thus, one of the important features of the present invention is the convenient manner in which the pair of plate members and attached pulleys are securely mounted in a back-to-back relationship on the intervening tent wall adjacent to the upper end of the tent zipper, for passing a cord through the plates and tent wall and about the pulleys, so that the cord can extend between the plate member pulleys and a pulley mounted adjacent to the lower end of the zipper. This enables the cord, which is attached to the sliding member of the tent zipper, merely to be pulled in the appropriate direction for opening and closing the tent zipper without requiring the individual operating the apparatus to bend, reach or otherwise strain to open and close the zipper. Another important feature of the invention is the manner of securing the lightweight plate members to the tent wall which prevents tearing damage to the tent wall fabric during operation of the apparatus.

Figure 9:
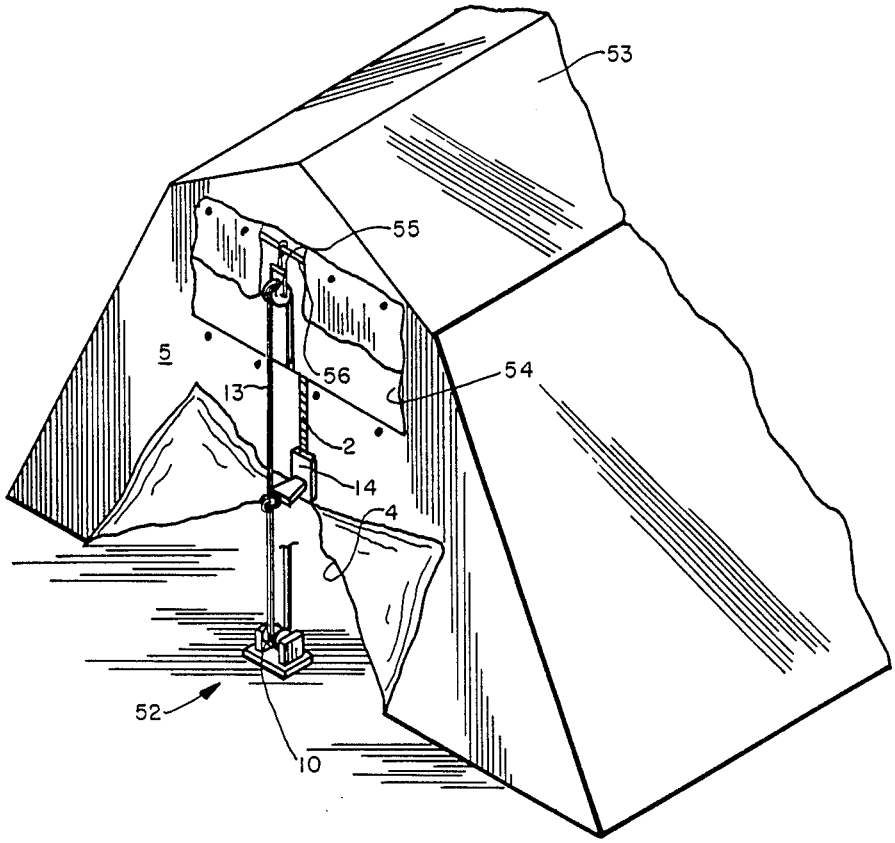
FIG. 9 is a fragmentary perspective view, with portions broken away, of a second embodiment of the apparatus of the present invention, mounted adjacent to a tent zipper for opening and closing the zipper.

A second embodiment of the present invention, is indicated generally at 52 and is shown in FIG. 9 in its intended use with a tent 53 of the type having an opening 54 formed adjacent to the upper end of zipper 2. Apparatus 52 is similar to apparatus 1 in most respects of construction and operation, except that plates 11 and attached pulleys 12 of apparatus 1 are replaced by a single pulley 55 which is suspended from a frame member 56 of the tent adjacent to opening 54, so that the pulley is aligned with the upper end of the zipper.

In summary, the apparatus of the present invention enables a person to open and close a vertically extending, generally straight-line zipper of a tent without bending or reaching to grasp the slide member of the zipper. Further, apparatus 1 is inexpensive, durable in use, and substantially maintenance-free.

Accordingly the apparatus for opening and closing tent zippers is simplified, provides an effective, safe, inexpensive, and efficient apparatus which achieves all the enumerated objectives, provides for eliminating difficulties encountered with prior apparatus, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved apparatus for opening and closing tent zippers is constructed and used, the characteristics of the construction, and the advantageous, new and useful results obtained; the new and useful structures, devices, elements, arrangements, parts and combinations, are set forth in the appended claims.

I claim:

1. An apparatus for moving a sliding member of a generally linearly vertically extending zipper attached to a wall of a tent, between an upper end and a lower end of the zipper for opening and closing an access opening formed in the tent all, said apparatus including:

(a) a first pulley mounted on a stake and adapted to be driven into the ground and positioned adjacent to and aligned with the lower end of the zipper;

(b) a second pulley adapted to be positioned adjacent to and aligned with the upper end of the zipper; and (c) cord means extending between the pulleys and adapted to be attached to the sliding member of the zipper, for moving the sliding member between the upper and lower ends of the zipper for opening and closing the access opening of the tent, upon movement of the cord means.

2. The apparatus defined in claim 1 in which the first pulley is removably mounted on the stake.

3. The apparatus defined in claim 1 in which the second pulley is adapted to be suspended from a frame member of the tent.

4. The apparatus defined in claim 1 in which a pair of plates each has a pulley rotatably mounted thereon and is adapted to be mounted adjacent to and aligned with the upper end of the zipper and a fist opening formed in the tent wall.

5. The apparatus defined in claim 4 in which suspension means is adapted to be attached to a frame member of the tent for suspending the plates adjacent to the upper end of the zipper.

6. The apparatus defined in claim 4 in which the pair of plates each is formed with a plurality of spaced openings; in which another opening is formed in the plate adjacent to and aligned with the pulley; and in which the plurality of spaced openings and the other opening of the plates are aligned with each other and with a plurality of corresponding spaced openings formed in the intervening wall of the tent adjacent to the upper end of the zipper and the first opening formed in the tent wall, respectively.

7. The apparatus defined in claim 6 in which fastening means pass through selected ones of the plurality of aligned spaced openings of the plates and tent wall for securely mounting the plates and attached pulleys on the tent wall adjacent to and aligned with the upper end of the zipper.

8. The apparatus defined in claim 1 in which catch means is attached to the cord means for connecting the cord means and the sliding member of the zipper.

9. The apparatus defined in claim 4 in which the cord means passes through the first opening formed in the tent wall and through an opening formed between a supporting surface for the tent and the tent wall adjacent to the lower end of the zipper, for extending between the pulleys.

10. In combination, a tent having a generally linearly vertically extending zipper attached to a wall thereof, and an apparatus for moving a sliding member of the zipper between an upper end and a lower end of the zipper for opening and closing an access opening formed in the tent wall, said apparatus including:

(a) a first pulley positioned adjacent to and aligned with the lower end of the zipper;

(b) a second pulley positioned adjacent to and aligned with the upper end of the zipper; and (c) cord means attached to the sliding member of the zipper and extending between the pulleys, for moving the sliding member between the upper and lower ends of the zipper for opening and closing the access opening of the tent, upon movement of the cord means.

11. The apparatus defined in claim 10 in which the first pulley is mounted on a stake driven into the ground.

12. The apparatus defined in claim 11 in which the first pulley is removably mounted on the stake.

13. The apparatus defined in claim 10 in which the second pulley is suspended from a frame member of the tent.

14. The apparatus defined in claim 10 in which a pair of plates each has a pulley rotatably mounted thereon and is adapted to be mounted adjacent to and aligned with the upper end of the zipper and a first opening formed in the tent wall.

15. The apparatus defined in claim 14 in which suspension means is attached to a frame member of the tent for suspending the plates adjacent to the upper end of the zipper.

16. The apparatus defined in claim 14 in which the pair of plates each is formed with a plurality of spaced openings; in which another opening is formed in the plate adjacent to and aligned with the pulley; and in which the plurality of spaced openings and the other opening of the plates are aligned with each other and with a plurality of corresponding spaced openings formed in the intervening wall of the tent adjacent to the upper end of the zipper, and the first opening formed in the tent wall, respectively.

17. The apparatus defined in claim 16 in which fastening means pass through selected ones of the plurality of aligned spaced openings of the plates and tent wall for securely mounting the plates and attached pulleys on the tent wall adjacent to and aligned with the upper end of the zipper.

18. The apparatus defined in claim 10 in which catch means is attached to the cord means for connecting the cord means and the sliding member of the zipper.

19. The apparatus defined in claim 14 in which the cord means passes through the first opening formed in the tent wall and through an opening formed between a supporting surface for the tent and the tent wall adjacent to the lower end of the zipper, for extending between the pulleys.

* * * * *